US008419174B2

(12) United States Patent
Ma

(10) Patent No.: US 8,419,174 B2
(45) Date of Patent: Apr. 16, 2013

(54) CARTRIDGE FOR INK-JET PRINTER

(75) Inventor: Xiaotian Ma, Guangdong (CN)

(73) Assignee: Ninestar Image Co., Ltd., Zhuhai (CN)

( * ) Notice: Subject to any disclaimer, the term of this patent is extended or adjusted under 35 U.S.C. 154(b) by 0 days.

(21) Appl. No.: 12/988,545

(22) PCT Filed: Nov. 28, 2009

(86) PCT No.: PCT/CN2009/075192

§ 371 (c)(1),
(2), (4) Date: Oct. 19, 2010

(87) PCT Pub. No.: WO2010/094199

PCT Pub. Date: Aug. 26, 2010

(65) Prior Publication Data

US 2011/0292138 A1 Dec. 1, 2011

(30) Foreign Application Priority Data

Feb. 20, 2009 (CN) ..... 2009 1 0105619

(51) Int. Cl.
*B41J 2/175* (2006.01)

(52) U.S. Cl.
USPC ..... 347/86; 347/19; 347/49; 347/87; 347/85; 702/189

(58) Field of Classification Search ..... None
See application file for complete search history.

(56) References Cited

U.S. PATENT DOCUMENTS

| | | | | |
|---|---|---|---|---|
| 5,764,260 | A * | 6/1998 | Vu et al. | 347/87 |
| 6,976,749 | B2 * | 12/2005 | Sasaki et al. | 347/49 |
| 7,510,257 | B2 * | 3/2009 | Jung et al. | 347/19 |
| 2002/0175979 | A1 * | 11/2002 | Morita et al. | 347/86 |
| 2004/0210424 | A1 * | 10/2004 | Seino et al. | 702/189 |
| 2008/0136879 | A1 * | 6/2008 | Sakai et al. | 347/86 |

* cited by examiner

*Primary Examiner* — Matthew Luu
*Assistant Examiner* — John P Zimmermann
(74) *Attorney, Agent, or Firm* — Jackson IPG PLLC

(57) ABSTRACT

The invention relates to a cartridge for ink-jet printer, comprising a cartridge body, a protective cover moving relatively to the cartridge body under pressure and a detection mechanism for cartridge and remaining ink volume, wherein the detection mechanism for cartridge and remaining ink volume includes the first and second detecting members respectively matching to the first and second sensors on the printer as well as a soft support cap set on the cartridge body and communicating to the ink storage chamber, of which the said second detecting member includes a movable lever, a fixed shaft set on the cartridge body, and a position adjustment member for the movable lever set on the protective cover. The said movable lever is connected with the rotating shaft of the cartridge body through the fixed shaft. It not only meets the detection requirement for cartridge and remaining ink volume, but also removes the movable lever in the ink storage chamber, greatly simplifying production processes and promoting identification accuracy.

4 Claims, 4 Drawing Sheets

CARTRIDGE FOR INK-JET PRINTER

BACKGROUND OF THE INVENTION

1. Field of the Invention

The invention relates to a cartridge for ink-jet printer.

2. Descriptions of the Related Art

The existing cartridge matching to ink-jet printer includes a cartridge body, a protective cover moving relatively to the cartridge body under pressure, a detection mechanism for cartridge and remaining ink volume, wherein the cartridge body includes an ink storage chamber, an ink outlet for providing ink to the printing head and an air inlet. The cartridge must include two kinds of detection mechanism in order to ensure the normal operation of cartridge after installed in the printer. During the installation process of cartridge on the printer, one detection mechanism at first prevents the light from the emission member of the second sensor from returning to the reception member of the second sensor, and then allows such light to return to the reception member of the second sensor with the installation progress. After that, the other detection mechanism prevents the light from the emission member of the first sensor from returning to the reception member of the first sensor, and finally, the light from the emission member of the first and second sensors is prevented from returning to corresponding reception member. Installation detection is completed after that, and then the printer gives a prompt that cartridge installation is completed to go to the next operation. The mechanism of the existing cartridge for detecting cartridge and ink volume is shown as FIG. 1, comprising the first detecting member a, the second detecting member b, the third detecting member c, a light transmission member d and a movable lever e. The said detection mechanism is realized by sheltering the light from sensor, whereof the operating principle is as follows: when cartridge is installed in the printer, the light from the second sensor in the printer is sheltered by the second detecting member b initially and then connected without the shelter of the second detecting member b with the installation of cartridge. After that, the light from the first sensor is sheltered by the first detecting member a, and finally the light from the second sensor is also sheltered by the third detecting member c, whereafter the printer gives a prompt of the existence of cartridge for the next operation. The said third detecting member c is comprised of a light transmission member d and a lightproof movable lever e, the position of the latter may vary with the ink volume in the cartridge, and the light from the second sensor can detect the ink volume in the cartridge according to the fact whether the light is sheltered by the third detecting member c.

The solution involves too many detecting members and the processes are too complex in terms of installation detection of the printer. When ink is detected to be run out, the defect is the design of lever. Complex processes of float installation reduce the production efficiency of the cartridge. In addition, the material for the light-sheltering member moving with the change of ink volume in the cartridge must be lightproof, while black PP material is used in the above project, so it is required to mix the black color with PP material uniformly during molding production, otherwise identification will not be performed accurately for installation of cartridge into the printer. The light-sheltering member has to move with the change of the ink volume in the cartridge, which requires many members, resulting in complex production processes and inferior identification accuracy.

SUMMARY OF THE INVENTION

It is, inter alia, an object of the invention to provide a cartridge for ink-jet printer to resolve the technical problem in existing complex production processes and inferior identification accuracy of cartridge in ink-jet printer.

In order to solve the said problem, the invention is to take a technical solution, comprising:

A cartridge for ink-jet printer comprising a cartridge body, a protective cover moving relatively to the cartridge body under pressure and a detection mechanism for cartridge and remaining ink volume, the said cartridge body including an ink storage chamber, an ink outlet for providing ink to the printing head and an air inlet, characterized in that the said detection mechanism of cartridge and remaining ink volume includes the first and second detecting members respectively matching to the first and second sensors of the printer, and a soft support cap set on the cartridge body and connecting to the ink storage chamber, the said second detecting member includes a movable lever, a fixed shaft set on the cartridge body, and a position adjustment member for the movable lever set on the protective cover, of which the said movable lever is connected with the rotating shaft of the cartridge body through the fixed shaft, the position adjustment member of the movable lever can be connected to the under-part of the movable lever under gravity, and the said soft support cap is located at the position corresponding to dropping position of the movable lever under gravity so as to be connected with the movable lever when the position adjustment member of the movable lever is above the soft support cap.

The said position adjustment member of movable lever is a draw hook.

A sealed ink bag is installed in the said ink chamber, the sealed ink bag is connected with the said support cap.

After adopting the above technical solution, the detection mechanism for cartridge and remaining ink volume includes the first and second detecting members respectively matching to the first and second sensors on the printer, and a soft support cap set on the cartridge body and connecting to the ink storage chamber, wherein the said second detecting member includes a movable lever, a fixed shaft set on the cartridge body, and a position adjustment member for the movable lever set on the protective cover, of which the said movable lever is connected with the rotating shaft of the cartridge body through the fixed shaft, the position adjustment member of the movable lever can be connected to the under-part of the movable lever under the gravity of movable member, and the said soft support cap is located at the position corresponding to dropping position of the movable lever under gravity so as to be connected with the movable lever when the position adjustment member of the movable lever is above the soft support cap. In view of the above, it not only meets the detection requirement for cartridge and remaining ink volume, but also removes the movable lever in the ink storage chamber, greatly simplifying production processes and promoting identification accuracy, consequently resolving the existing technical problem of complex production processes and inferior identification accuracy in terms of the cartridge of ink-jet printer.

DETAILED DESCRIPTION OF THE PREFERRED EMBODIMENTS

Figure 1:
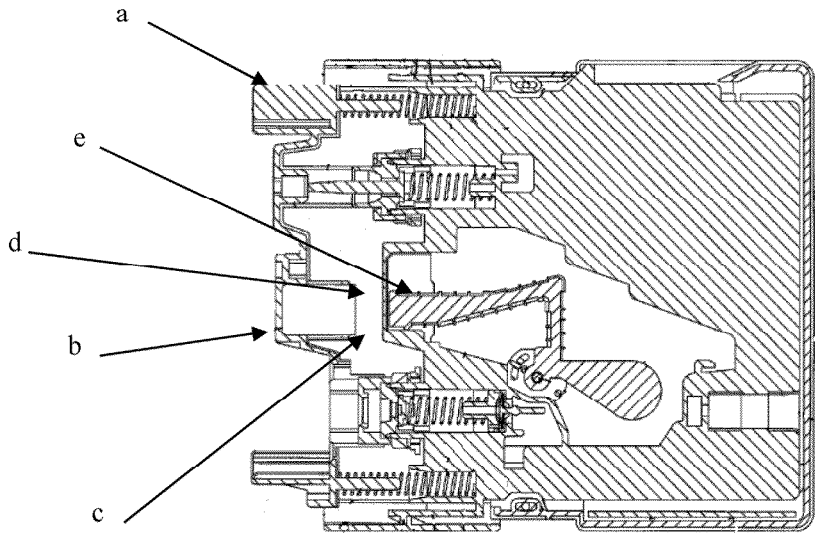
FIG. 1 illustrates a structural diagram of the existing cartridge.
Figure 2:
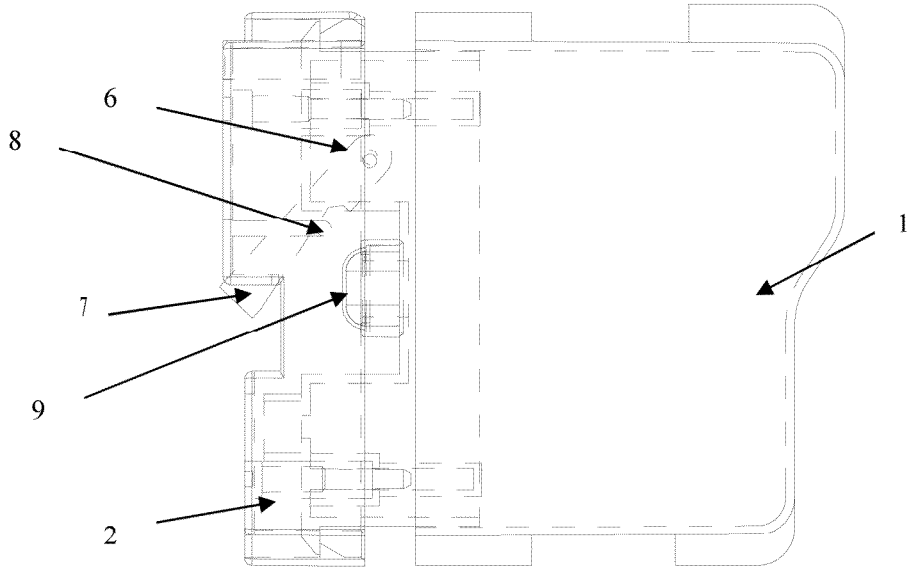
FIG. 2 illustrates a structural diagram of the invention.
Figure 10:
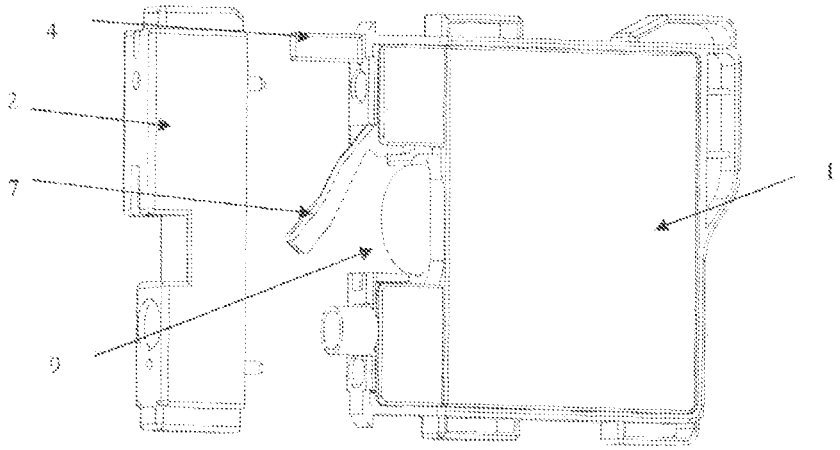
FIG. 10 illustrates an exploded structural diagram for the cartridge of the invention.

FIGS. 2 and 10 show a cartridge for ink-jet printer, comprising a cartridge body 1, a protective cover 2 moving relatively to the cartridge body 1 under pressure and a detection mechanism for cartridge and remaining ink volume, wherein the cartridge body 1 includes an ink storage chamber, an ink outlet for providing ink to the printing head and an air inlet, and the detection mechanism for cartridge and remaining ink volume includes the first detecting member 4 and the second detecting member respectively matching to the first sensor 3 and second sensor 5 on the printer as well as a soft support cap 9 set on the cartridge body 1 and connecting to the ink storage chamber. The said second detecting member includes a movable lever 7, a fixed shaft 6 set on the cartridge body 1, and a position adjustment member for the movable lever 7 set on the protective cover 2, wherein the said movable lever 7 is connected with the rotating shaft of the cartridge body through the fixed shaft 6, the position adjustment member of the movable lever 7 can be connected to the under-part of the movable lever 7 under the gravity of the movable lever 7, and the said soft support cap 9 is located at the position corresponding to the dropping position of the movable lever 7 under its gravity so as to be connected with the movable lever 7 when the position adjustment member of the movable lever 7 is above the soft support cap 9. The position adjustment member of movable lever 7 is a draw hook 8. A sealed ink bag is set in the ink storage chamber, connecting with the soft support cap 9.

Figure 3:
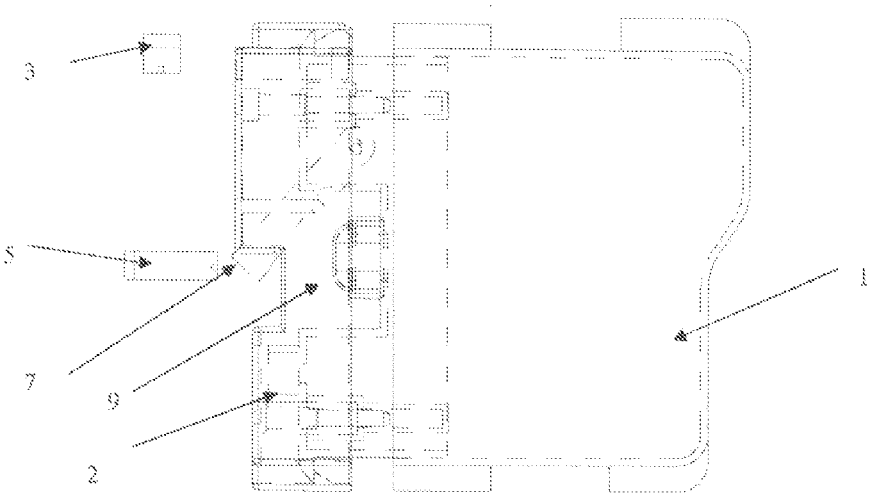
FIG. 3 illustrates a diagram of relative position between the cartridge and the first and second sensors which are connected before the cartridge of the invention is installed in the printer.
Figure 4:
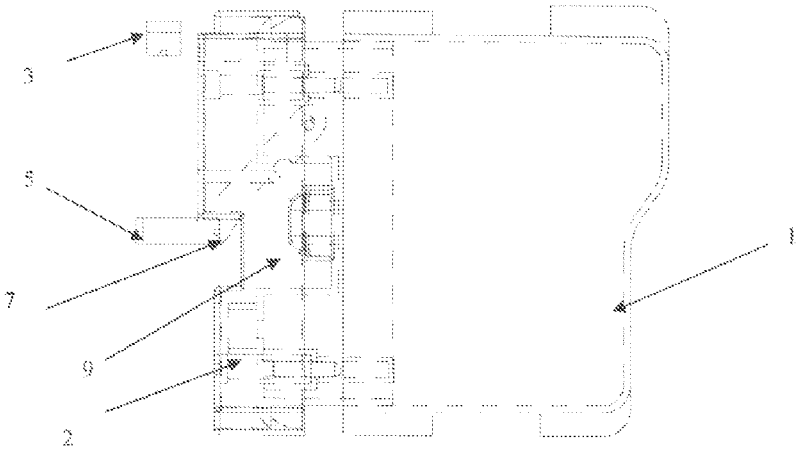
FIG. 4 illustrates a diagram of relative position between the cartridge and the first and second sensors, wherein the second sensor is disconnected and the first sensor is connected when the cartridge of the invention is just installed in the printer.
Figure 5:
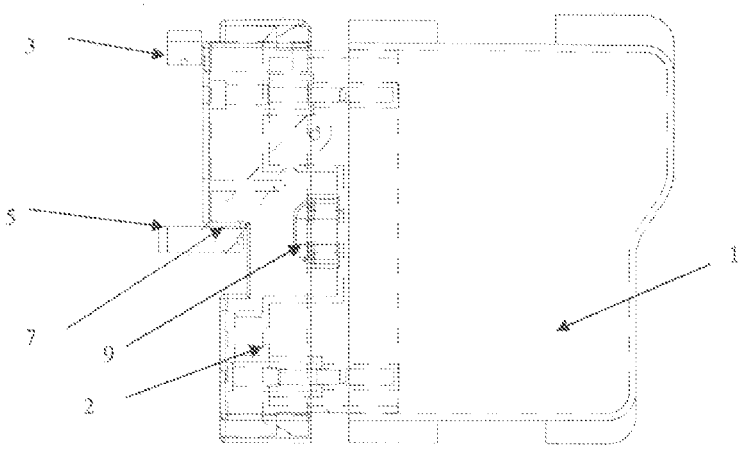
FIG. 5 illustrates a diagram of relative position between the cartridge and the first and second sensors, wherein the light path of the second sensor is connected and that of the first sensor is disconnected during the process of installing the cartridge of the invention in the printer.
Figure 6:
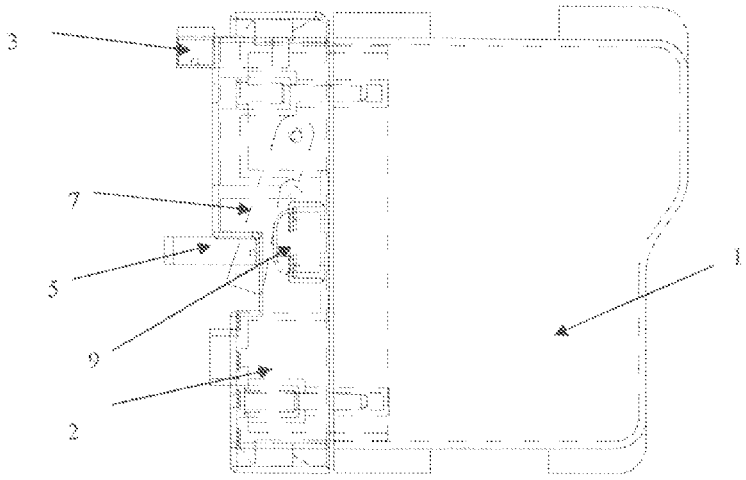
FIG. 6 illustrates a diagram of relative position between the cartridge and the first and second sensors, wherein the light paths of the two sensors are disconnected when the cartridge of the invention is successfully installed in the printer.
Figure 7:
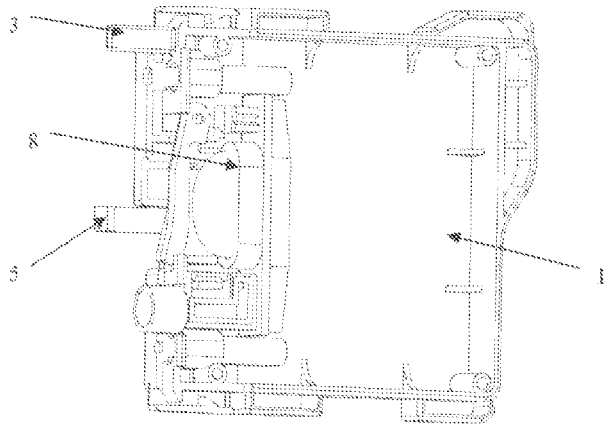
FIG. 7 illustrates a three-dimensional embodiment diagram for the relative position between the cartridge and the first and second sensors, wherein the two paths of the sensors are disconnected.

During the process of installing the cartridge in the printer, both sensors in the printer are under the status of connection shown as FIG. 3. With the installation progress of the cartridge, the protective cover 2 at the front end of the cartridge is not moved while the second sensor 5 is started to be connected to the second detecting member, resulting in emission of light from the emission member of the second sensor 5, which can not return to the reception member of the second sensor 5 due to the shelter of the movable lever 7 of the second detecting member. Under this circumstance, the light path of the second sensor 5 is disconnected while the first sensor 3 is in connection without contacting the first detecting member 4 shown as FIG. 4. With the further installation of the cartridge, the movable lever 7 goes through the detecting member of the second sensor 5, resulting in the first sensor 3 being sheltered by the first detecting member 4 to be in disconnection while the second sensor 5 being not sheltered by the movable lever 7 to be in connection shown as FIG. 5. Then, the protective cover 2 at the front end of the cartridge moves in the opposite direction of the cartridge, the draw hook 8 fixing on the protective cover 2 moves backward and don't support the movable lever again, which sags down under gravity. At this time, one end of the movable lever 7 of the second detecting member reaches the response position of the second sensor 5 then supported by the soft support cap 9, sheltering the light from the second sensor 5 again. The second sensor 5 is in disconnection shown as FIGS. 6 and 7. The light from the first sensor 3 is sheltered by the first detecting member 4, making the first sensor 3 in disconnection. The cartridge of the printer is now available.

Figure 8:
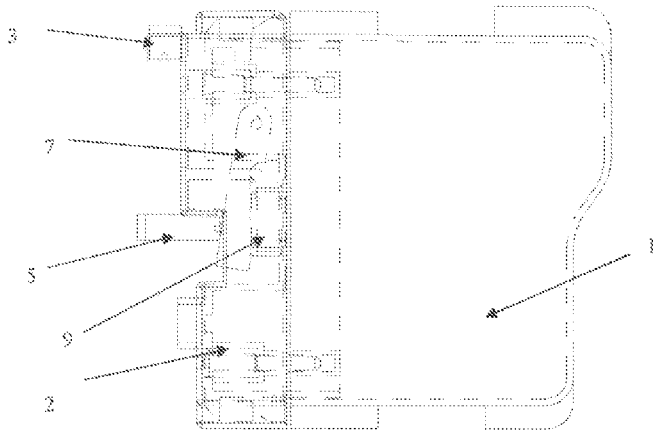
FIG. 8 illustrates a diagram of relative position between the sensor and the detecting member for cartridge of the printer when there's no ink in the cartridge of the invention.
Figure 9:
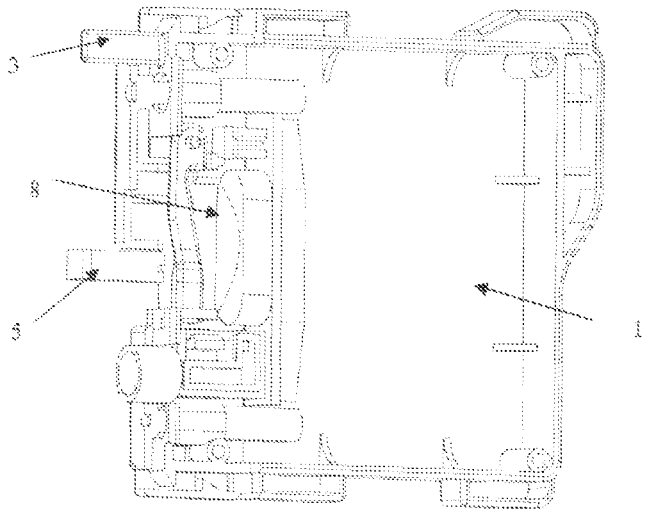
FIG. 9 illustrates a three-dimensional embodiment diagram of relative position between the sensor and the detecting member for cartridge of the printer when there's no ink in the cartridge of the invention.

When there's enough ink in the cartridge, put the cartridge in the printer for printing. The light from the emission member is prevented by one end of the second detecting member from reaching the light reception member of printer, according to which the printer identifies that there's enough ink in the cartridge. When there's no ink in the cartridge shown as FIGS. 8 and 9, as the cartridge body 1 uses sealed ink bag, the soft support cap 9 connecting to it sags down due to the drying of the ink bag with the reduction of ink under the suck of the ink-providing needle in the printer. The movable lever 7 of the second detecting member continues moving under gravity to leave the position sheltering the light path of the second sensor 5. When light reaches the light reception member, the printer gives a prompt for running out of ink and then a signal for changing the cartridge.

Figure 11:
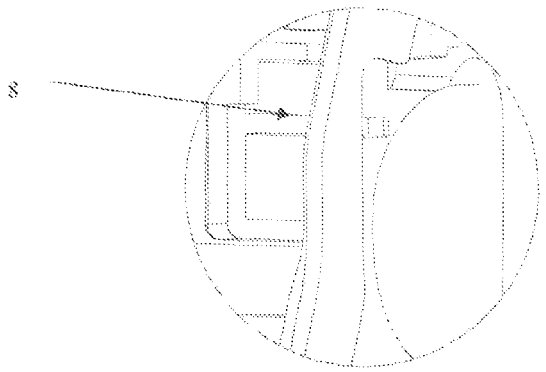
FIG. 11 illustrates a diagram of the draw hook set on the protective cover for the cartridge of the invention.

When the cartridge is taken out of the printer as FIG. 11, the draw hook 8 on the protective cover 2 will pull up the movable lever 7 again to let it return to the position before installation, realizing reset.

The invention realizes the functions of both original detecting members by using the second detecting member of the cartridge. In terms of manufacturing, it is featured in simple processes, easy control and reduced cost. In addition, it uses an ink storage bag to increase ink capacity, reducing user's printing cost.

What is claimed is:

1. A cartridge for an ink-jet printer comprising a cartridge body, a protective cover moving relative to the cartridge body under pressure, a detection mechanism for the cartridge and remaining ink volume, said cartridge body including an ink storage chamber, an ink outlet for providing ink to the printing head and an air inlet, characterized in that said detection mechanism for the cartridge and remaining ink volume includes first and second detecting members respectively matching to first and second sensors on the printer, and a soft support cap set on the cartridge body and connecting to the ink storage chamber, of which the said second detecting member includes a movable lever, a fixed shaft set on the cartridge body, and a position adjustment member for the movable lever set on the protective cover, said movable lever is connected to the rotating shaft of the cartridge body through the fixed shaft, said movable lever is positioned to rest on said soft support cap such that when the volume of ink in the ink storage chamber decreases, the volume of the soft support cap decreases causing the movable lever to move from a position blocking the second sensor to a position not blocking the second sensor thus indicating to the printer there is insufficient ink left in the ink storage chamber.

2. The cartridge for the ink-jet printer as claimed in claim 1, wherein the said position adjustment member of the movable lever is a draw hook.

3. The cartridge for the ink-jet printer as claimed in claim 1, wherein a sealed ink bag is installed in said ink chamber, the sealed ink bag is connected to the said support cap.

4. The cartridge for the ink-jet printer as claimed in claim 1, wherein the position adjustment member of the movable lever is connected to the under-part of the movable lever under gravity.

* * * * *